US005258277A

United States Patent [19]

Ogata et al.

[11] Patent Number: 5,258,277

[45] Date of Patent: Nov. 2, 1993

[54] SUPPORT MEMBER FOR PHOTOGRAPHIC PRINTING PAPER

[75] Inventors: Yasuhiro Ogata; Tetsuro Fuchizawa, both of Fujinomiya, Japan

[73] Assignee: Fuji Photo Film Co., Ltd., Kanagawa, Japan

[21] Appl. No.: 43,785

[22] Filed: Apr. 6, 1993

[30] Foreign Application Priority Data

Apr. 7, 1992 [JP] Japan ..... 4-085377

[51] Int. Cl.[5] ..... G03C 1/775

[52] U.S. Cl. ..... 430/538; 428/507; 428/513; 428/514; 430/531; 430/536; 430/537

[58] Field of Search ..... 430/538, 523, 531, 536, 430/537; 528/241, 438, 441; 428/507, 513, 514

[56] References Cited

U.S. PATENT DOCUMENTS 4,220,471 9/1980 Date et al. ..... 430/538
4,921,781 5/1990 Takamuki et al. ..... 430/538
5,008,150 4/1991 Ashida et al. ..... 430/538

*Primary Examiner*—Jack P. Brammer
*Attorney, Agent, or Firm*—Sughrue, Mion, Zinn, Macpeak & Seas

[57] ABSTRACT

In the support member for photographic printing paper of the present invention, a white reflective layer is placed on a base material by coating and drying a coating composition, said coating composition contains a white pigment having titanium oxide as principal component and a binder having a copolymer of vinyl chloride - vinyl acetate and maleic acid anhydride soluble in organic solvent and having polymerization degree of 250 or more, said copolymer containing vinyl chloride, vinyl acetate and maleic acid anhydride by component ratio of 20–90 weight %: 5–50 weight %: 2–10 weight %. Thus, the support member can provide photographic image with high resolving power, has high bonding property with base material and silver halide emulsion layer, is easier to produce, and causes discoloring less frequently due to time or heat.

3 Claims, No Drawings

SUPPORT MEMBER FOR PHOTOGRAPHIC PRINTING PAPER

BACKGROUND OF THE INVENTION

The present invention relates to a support member for photographic printing paper, and in particular to a support member for photographic printing paper with high resolving power.

In recent years, a support member for waterproof photographic printing paper, both sides of which are coated with polyolefin such as polyethylene for rapid development processing of photographic printing paper. However, photographic image obtained from the photographic printing paper using polylefin-coated paper is disadvantageous in that resolving power is not very high.

This disadvantage is attributable to the fact that light scatters within polyolefin layer because white pigment mixed in the polyolefin layer, which is coated on the surface of the polyolefin-coated support member to contact with photosensitive silver halide emulsion is not sufficient in quantity and its shielding effect is not strong enough.

Normally, titanium oxide is used as the white pigment. Improvements of surface coating of titanium oxide to increase the quantity filled into polyolefin have been disclosed in Japanese Patent Laid-Open Publication No. 55-108658 and Japanese Patent Laid-Open Publication No. 57-35855, etc., and simultaneous use with other pigment is disclosed in Japanese Patent Publication No. 49-27046. In any case, however, filling quantity of titanium oxide is up to 15 weight % at the highest.

In this respect, methods are described in Japanese Patent Publication No. 57-53937 and Japanese Patent Laid-Open Publication No. 57-64235, by which a white pigment layer comprising white pigment and hydrophilic colloid solution is placed on a film or a resin-coated paper, and a photosensitive emulsion layer is placed on the white pigment layer. In the photographic printing paper using the support member disclosed in these patents, binder of the white pigment layer is hydrophilic and absorbs development processing solution or water, and it is disadvantageous because drying is delayed compared with the photographic printing paper using ordinary polyolefin-coated paper as the support member.

A method to coat an aqueous emulsion comprising binding agent and pigment is disclosed in Japanese Patent Laid-Open Publication No. 50-44818. However, when aqueous material is coated, drying is delayed and high-speed processing is not achievable, or drying zone must be extremely enlarged. Further, when emulsion is used, mechanical stability of the emulsion is reduced and uniform coating is not accomplished when gravure roll or bar are coated continuously.

To overcome the above problems, Japanese Patent Laid-Open Publication No. 59-200234 discloses a method, by which a binder soluble in organic solvent and white pigment are coated.

As the binder soluble in organic solvent, there are polyvinyl chloride, vinyl chloride-acetic acid copolymer, polyvinyl acetate, or polystyrene. However, mere use of such binders leads poor binding between base material and binder layer containing white pigment or the binding between layer and silver halide emulsion layer. Thus, it is necessary to perform surface treatment such as corona processing or lining in advance on the base material or on the surface of the binder layer. This results in more complicated manufacturing process and higher cost. Also, the use of polymer containing vinyl chloride causes discoloring to yellow as time elapses or by heat.

It is a first object of the present invention to provide a support member for photographic printing paper, by which a photographic image with high resolving power can be obtained.

It is a second object of the present invention to provide a support member for photographic printing paper, which has high bonding property with base material or with silver halide emulsion layer and is easier to manufacture.

It is a third object of the present invention to provide a support member for photographic printing paper, which is not easily discolored as time elapses or by heat.

SUMMARY OF THE INVENTION

To attain the above objects, the support member for photographic printing paper according to the present invention comprises a white reflective layer by coating and drying a coating composition on base material, said coating composition containing a white pigment having titanium oxide as principal component, and a binder, which is soluble in organic solvent and has a copolymer of vinyl chloride—vinyl acetate—maleic acid anhydride having polymerization degree of 250 or more as principal component, and said copolymer containing vinyl chloride, vinyl acetate and maleic acid anhydride by component ratio of 20–90 weight %, 5–50 weight %, and 2–10 weight %.

By the support member for photography of the present invention, it is possible to obtain photographic image with high resolving power, and it has high bonding property with base material or with silver halide emulsion layer, is easier to manufacture, and is not easily discolored due to time or heat.

DETAILED DESCRIPTION OF THE PREFERRED EMBODIMENT

In the following, detailed description will be given on the features of the present invention.

Titanium dioxide used as principal component of the white pigment in the present invention has high masking ability. The titanium dioxide may be rutile type or anatase type, or it may produced by sulfuric acid method or by chlorine method. It is preferable to use titanium oxide, which has been processed by inorganic surface treatment such as alumina hydrate processing and/or silicon dioxide hydrate processing or processed by organic coating treatment with trimethylolmethane, trimethylolethane, trimethylol-propane, 2,4-dihydroxy-2-methylpentane, etc. or processed by surface treatment with surface active agent. Among these, the one processed by inorganic surface treatment such as alumina hydrate processing and/or silicon dioxide hydrate processing is preferable because discoloring due to time or heat occurs less frequently.

Other pigment may be used together with titanium dioxide, which is primarily used in the present invention. Such pigments are, for example: barium sulfate, calcium sulfate, barium carbonate, calcium carbonate, lithopone, alumina white, zinc oxide, silica white, antimony trioxide, titanium phosphate, etc. For the ratio of titanium dioxide to the other pigment, it is preferable to use titanium dioxide by 50 weight % or more, or more preferably by 70 weight % or more, or still more preferably by 90 weight % or more. It is most preferable to use titanium dioxide alone.

To disperse white pigment, it is possible to use dispersion aid such as surface active agent if necessary. Further, preferable fine dispersion substance can be obtained if various types of dispersing device (e.g. homomixer, homogenizer, ball mill, colloid mill, sand mill, dyno-mill, etc.) are used.

Various types of photographic additives such as organic dye or inorganic dye, fluorescent brightener, hardening agent, antifoggant, stabilizer or coloring preventive agent during developing process such as tetrazaidene or tetrazole may be added to white pigment layer.

In the present invention, white pigment is used to the binder by about 20 weight % or more, or more preferably by 30–80 weight %. White pigment is coated by about 3–20 g per square meter.

If the coating quantity of white pigment is less than 3 $g/m^2$, masking power is low, and photographic image with high resolving power cannot be obtained. If the coating quantity of white pigment is more than 20 $g/m^2$, the resolving power remains the same, and this is useless in terms of cost.

As the principal component of the binder used in the white pigment layer of the present invention, a copolymer is used, which is soluble in organic solvent and is vinyl chloride—vinyl acetate—maleic acid anhydride having polymerization degree of 250 or more, whereby component ratio of vinyl chloride, vinyl acetate and maleic acid anhydride is 20–90 weight %:5–50 weight %:2–10 weight %.

Any organic solvent may be used, which dissolves the binder and has low toxicity. For example, it is preferable to use acetone, methylethylketone, ethyl acetate, toluene, methanol, butyl acetate, isopropyl acetate, cyclohexanone. ethyl lactate, etc. More preferably, ethyl acetate, toluene, methylethylketone, butyl acetate, cyclohexanone or mixture of these solvents may be used.

As the copolymer, ternary copolymer of vinyl chloride—vinyl acetate—maleic acid anhydride is preferably used. Quarternary copolymer containing vinylidene chloride, i.e. vinylidene chloride—vinyl chloride—vinyl acetate—maleic acide anhydride may be used.

The component ratio of the copolymer is: (1) vinyl chloride by 20–90 weight %, (2) vinyl acetate by 5–50 weight %, and (3) maleic acid anhydride by 2–10 weight %. If the ratio of vinyl chloride is lower, hydrophobic property decreases and membrane strength is weakened when wetted. If the ratio of vinyl acetate is high, blocking occurs. If it is low, coloring by developing solution increases. If maleic acid anhydride is low, emulsion contact property is worsened. Further, it is preferable to use copolymer, which contains (1) vinyl chloride by 20–75 weight %, (2) vinyl acetate by 5–30 weight %, and (3) maleic acid anhydride by 2–5 weight %.

If only polyvinyl chloride and vinyl chloride—acetate copolymer is used, bonding with base material or bonding with silver halide emulsion layer is not sufficient, and it is preferable to use copolymer of maleic acid anhydride and vinyl chloride—vinyl acetate. When maleic acid anhydride is hydrolyzed to maleic acid or it is decomposed to alcohol, this is not preferable because of poor bonding.

When vinyl chloride—vinyl acetate—maleic acid anhydride copolymer is used as binder, the support member is discolored (to yellow) as time elapsed or by heat, thus reducing the value as a commercial product. After making fervent efforts on study, the present inventors have found that the discoloring due to time and heat can be prevented by the use of vinyl chloride—vinyl acetate—maleic acid anhydride copolymer with polymerization degree of 250 or more as binder, and finally reached the present invention.

In the present invention, the polymerization degree is preferably 250 or more, or more preferably 300 or more, or most preferably 350 or more. There is no secific upper limit for the polymerization degree, but it is preferably 1,000 or less. If polymerization degree of polymer is 1,000 or more, viscosity of coating solution increases, and it cannot be coated because of high concentration of solids. This necessitates the use of large quantity of diluting solvent, and it is economically disadvantageous. Further, polymerization degree is preferably 800 or less, or more preferably 600 or less. Small quantity of so-called vinyl chloride type stabilizer may be added to vinyl chloride—vinyl acetate—maleic acid anhydride copolymer with polymerization degree of 250 or more of the present invention. As the vinyl chloride type stabilizer, there are epoxidated fatty acid alkyl ester, epoxidated animal and vegetable oils, organic tin compound, etc.

As the bonding agent, other polymer or compound may be used with or added to @he copolymer of the present invention. For example, there are polyurethane resin, polyurea resin, phenol resin, melamine resin, polyester resin, silicon resin, cellulose resin, acrylic resin, polyamide resin, fluororesin, styrene resin, vinyl acetate resin, polyolefin resin, etc. Among these, it is most preferable to use polyurethane urea resin as the polymer for simultaneous use.

The coating solution used in the present invention can be coated by the coating method commonly known, e.g. dip coating method, air-knife coating method, curtain coating method, roller coating method, doctor coating method, wire bar coating method, slide coating method, gravure coating method, or extrusion coating method using the hopper described in the specification of U.S. Pat. No. 2,681,294.

As the base material to be used in the present invention, there are resin-coated paper coated with polyolefin such as polyethylene, polypropylene, etc., synthetic macromolecular film such as polyethylene film, polypropylene film, polystyrene, polyethylene terephthalate, polycarbonate, hard vinyl chloride, etc., natural macromolecular film such as cellulose diacetate, cellulose triacetate, nitrocellulose, etc. or paper made of natural pulp, synthetic pulp, etc. and synthetic paper or PET film filled with white pigment, etc.

These base materials may be processed by pre-treatment to increase bonding property with the binder layer, which contains white pigment. As the method for pre-treatment, there are a method to immerse in oxidizing solution, flame treatment, corona discharge treatment, glow discharge treatment, or activation treatment by ultraviolet ray irradiation. It is preferable to use corona discharge treatment as the easiest and economical method.

As the silver halide emulsion of silver halide photographic layer, most advantageously used for the execution of the present invention, various types of substances may be used. For example, as silver halide composition, emulsion such as silver chloride, silver bromide, silver chlorobromide, silver chloroiodobromide, silver iodochloride, silver iodobromide, etc. or a mixture of these substances may be used for each individual purpose.

Negative silver halide emulsion may be used, or direct positive silver halide emulsion may be used if necessary. The photographic layer may be provided immediately adjacent to the white pigment layer, or gelatin undercoating layer may be provided, and the photographic layer may be placed on it. When the photographic layer or the undercoating layer is provided immediately adjacent to the white pigment layer, the surface of the white pigment layer may be processed by surface treatment such as-corona treatment.

EXAMPLE

On polyethylene surface of a polyethylene-coated paper, both sides of which are coated with polyethylene, the binder shown in Table 1 below and anatase type titanium oxide were coated in such manner that the weight ratio of the binder processed by alumina surface treatment and silicon dioxide surface treatment to the titanium oxide is 1:1, and that coating quantity of the titanium oxide when dried is 10 g/cm$^2$. Emulsion for color photographic paper was coated on it to prepare photographic printing paper.

The photographic printing paper thus prepared was processed by developing, fixing and washing treatment.

After processing, the emulsion layer was rubbed with finger to cheek contact property.

The whiteness of white portion of the image was measured by a reflection type spectrophotometer, and reflectance was determined at wavelength of 440 nm.

The white portion was placed into an oven kept at 80° C. and 70% RH for 5 days, and reflectance was measured by similar procedure at wavelength of 440 nm. The smaller this value is, the higher the discoloring is.

On the photographic printing paper thus prepared, a resolving power chart was printed by green exposure. After processed by developing, fixing and washing, density of magenta image was measured by microphotometer. The ratio of density difference of thin lines of 10 lines/mm to the density difference on large area portion was regarded as resolving power response (%) as given by the following equation. The higher this value is, the higher the sharpness is.

In the following equation, a represents the highest density in thin lines of 10 lines/mm, b is the lowest density in thin lines of 10 lines/mm, A is the highest density on the large area portion, and B is the lowest density on the large area portion.

$$\text{Resolving power response (\%)} = \frac{a-b}{A-B}$$

As a comparative sample, photographic printing paper made of ordinary polyethylene-coated paper without white pigment coated layer was used.

In Table 1, the mark x in the column of emulsion contact means that emulsion layer was detachable when rubbed with finger. The mark o indicates that the contact property was high.

TABLE 1

| | Binder composition (weight %) | Polymerization degree of polymer | Property: Resolving power | Emulsion contact property | Reflectance of white portion | Heat resisting reflectance |
|---|---|---|---|---|---|---|
| Examples | | | | | | |
| (1) | Vinyl chloride - vinyl acetate - maleic acid anhydride (80:15:5) | 400 | 92% | o | 87% | 82% |
| (2) | Vinylidene chloride - vinyl chloride - vinyl acetate - maleic acid anhydride (10:70:15:5) | 400 | 91% | o | 86% | 82% |
| (3) | Vinyl chloride - vinyl acetate - maleic acid anhydride (75:23:2) | 300 | 92% | o | 87% | 80% |
| Comparative examples | | | | | | |
| (1) | Vinyl chloride - vinyl acetate - maleic acid anhydride (80:15:5) | 150 | 90% | o | 87% | 57% |
| (2) | Vinyl chloride - vinyl acetate - maleic acid (80:15:5) | 400 | 91% | x | 87% | 82% |
| (3) | Vinyl chloride - vinyl acetate - maleic acid anhydride (76:23:1) | 300 | 89% | x | 86% | 80% |
| (4) | Ordinary photographic printing paper | — | 68% | o | 85% | 80% |

From this table, it is evident that the support member for photographic printing paper of the present invention can provide photographic image with high resolving power, has high bonding property with base material or silver halide emulsion layer, is easier to produce, and causes discoloring less frequently as time elpases or by heat.

What we claim is:

1. A support member for photographic printing paper, comprising a white reflective layer the expression produced by coating and drying a coating composition on a resin-coated paper base said coating composition containing a white pigment having titanium oxide as principal component, and a binder, which is soluble in organic solvent and has a copolymer of vinyl chloride—vinyl acetate—maleic acid anhydride having polymerization degree of 250 or more as principal component, and said copolymer containing vinyl chloride, vinyl acetate and maleic acid anhydride by component ratio of 20–90 weight %, 5–50 weight %, and 2–10 weight %.

2. A support member for photographic printing paper according to claim 1, wherein component ratio of vinyl chloride, vinyl acetate and maleic acid anhydride in copolymer of vinyl chloride—vinyl acetate—maleic acid anhydride is 20–75 weight % : 5–30 weight % : 2–5 weight %.

3. A support member for photographic printing paper according to claim 1, wherein the white pigment is contained by 30–80 weight % to the binder, and coating quantity of the white pigment is within the range of 3–20 g per square meter.

* * * * *